US007404457B2

(12) United States Patent
Xu et al.

(10) Patent No.: US 7,404,457 B2
(45) Date of Patent: Jul. 29, 2008

(54) DOWNHOLE ABRADING TOOLS HAVING FUSIBLE MATERIAL AND METHODS OF DETECTING TOOL WEAR

(75) Inventors: Yang Xu, Houston, TX (US); Gerald Lynde, Houston, TX (US)

(73) Assignee: Baker Huges Incorporated, Houston, TX (US)

( * ) Notice: Subject to any disclaimer, the term of this patent is extended or adjusted under 35 U.S.C. 154(b) by 256 days.

(21) Appl. No.: 11/480,028

(22) Filed: Jun. 30, 2006

(65) Prior Publication Data

US 2008/0000687 A1 Jan. 3, 2008

(51) Int. Cl.
*E21B 12/02* (2006.01)

(52) U.S. Cl. ..... 175/57; 175/39

(58) Field of Classification Search ..... 175/39, 175/42

See application file for complete search history.

(56) References Cited

U.S. PATENT DOCUMENTS

| | | | | | |
|---|---|---|---|---|---|
| 2,457,960 | A | * | 1/1949 | Walker | 175/39 |
| 2,461,164 | A | * | 2/1949 | Lewis | 175/39 |
| 2,468,905 | A | * | 5/1949 | Warren, Jr. | 175/39 |
| 2,560,328 | A | | 7/1951 | Bielstein | |
| 2,582,312 | A | | 1/1952 | Del Homme | |
| 2,657,909 | A | | 11/1953 | Bielsten | |
| 2,658,724 | A | * | 11/1953 | Arps | 175/41 |
| 3,011,566 | A | | 12/1961 | Graham | |
| 3,062,302 | A | * | 11/1962 | Toth et al. | 175/39 |
| 3,155,176 | A | | 11/1964 | Bennett | |
| 3,578,092 | A | * | 5/1971 | Tesch et al. | 175/39 |
| 3,678,883 | A | | 7/1972 | Fisher | |
| 3,714,822 | A | | 2/1973 | Lutz | |
| 3,853,184 | A | | 12/1974 | McCullough | |
| 3,865,736 | A | | 2/1975 | Fries | |
| 4,189,012 | A | | 2/1980 | Garrett | |
| 4,627,276 | A | | 12/1986 | Burgess et al. | |

(Continued)

FOREIGN PATENT DOCUMENTS

GB 658323 A 10/1951

(Continued)

OTHER PUBLICATIONS

Office Action dated Feb. 12, 2008 in U.S. Appl. No. 11/479,231, U.S. Patent and Trademark Office.

(Continued)

*Primary Examiner*—Jennifer H Gay
*Assistant Examiner*—Cathleen R Hutchins
(74) *Attorney, Agent, or Firm*—Greenberg Traurig LLP; Anthony F. Matheny

(57) ABSTRACT

A downhole abrading tool has a body with a first end for connection to a drill string, a cutting end, a drilling fluid passageway, and a fusible material disposed within the body. The fusible material is capable of igniting and combusting in response to a selected temperature increase due to excessive wear on the cutting end. Combustion of the fusible material provides an indication to an operator of the downhole abrading tool of the excessive wear on the cutting end of the downhole abrading tool so that the downhole abrading tool can be removed from the well and replaced. The indication to the operator of the downhole abrading tool can be a temperature change or a pressure change in a drilling fluid flowing through the drilling fluid passageway.

20 Claims, 4 Drawing Sheets

U.S. PATENT DOCUMENTS

| | | | |
|---|---|---|---|
| 4,655,300 | A | 4/1987 | Davis et al. |
| 4,744,242 | A | 5/1988 | Anderson et al. |
| 4,785,895 | A | 11/1988 | Davis et al. |
| 4,818,153 | A | 4/1989 | Strandell et al. |
| 4,928,521 | A | 5/1990 | Jardine |
| 5,202,680 | A | 4/1993 | Savage |
| 5,305,836 | A | 4/1994 | Holbrook et al. |
| 5,415,030 | A | 5/1995 | Jogi et al. |
| 5,442,981 | A | 8/1995 | Vegh |
| 5,794,720 | A | 8/1998 | Smith et al. |
| 5,979,571 | A | 11/1999 | Scott et al. |
| 6,109,368 | A | 8/2000 | Goldman et al. |
| 6,131,675 | A | 10/2000 | Anderson |
| 6,233,524 | B1 | 5/2001 | Harrell et al. |
| 6,408,953 | B1 | 6/2002 | Goldman et al. |
| 6,414,905 | B1 | 7/2002 | Owens et al. |
| 6,443,228 | B1 | 9/2002 | Aronstam et al. |
| 6,484,824 | B2 | 11/2002 | Skyles |
| 6,631,772 | B2 | 10/2003 | Palaschenko |
| 6,648,082 | B2 | 11/2003 | Schultz et al. |
| 6,693,553 | B1 | 2/2004 | Ciglenec et al. |
| 6,725,947 | B2 | 4/2004 | Palaschenko et al. |
| 6,867,706 | B2 | 3/2005 | Collette |
| 6,915,848 | B2 | 7/2005 | Thomeer et al. |
| 6,923,273 | B2 | 8/2005 | Terry et al. |
| 6,943,697 | B2 | 9/2005 | Ciglenec et al. |
| 6,993,432 | B2 | 1/2006 | Jenkins et al. |
| 2004/0190374 | A1 | 9/2004 | Alft et al. |
| 2005/0267686 | A1 | 12/2005 | Ward |
| 2006/0000604 | A1 | 1/2006 | Jenkins et al. |
| 2006/0099885 | A1 | 5/2006 | Lynde et al. |
| 2007/0209802 | A1 | 9/2007 | Xu et al. |

FOREIGN PATENT DOCUMENTS

| | | | |
|---|---|---|---|
| GB | 1276311 | A | 6/1972 |
| WO | WO2005/113926 | A | 12/2005 |

OTHER PUBLICATIONS

Office Action dated Feb. 19, 2008 in U.S. Appl. No. 11/479,606, U.S. Patent and Trademark Office.

Office Action dated Feb. 20, 2008 in U.S. Appl. No. 11/496,663, U.S. Patent and Trademark Office.

Notification of Transmittal of the International Search Report and the Written Opinion of the International Searching Authority, Or the Declaration, Nov. 13, 2007, pp. 1-2, PCT/US2007/071926, European Patent Office.

International Search Report, Nov. 13, 2007, pp. 1-3, PCT/US2007/071926, European Patent Office.

Written Opinion of the International Searching Authority, Nov. 13, 2007, pp. 1-5, PCT/US2007/071926, European Patent Office.

Notification of Transmittal of the International Search Report and the Written Opinion of the International Searching Authority, Or the Declaration, Jan. 8, 2008, pp. 1-2, PCT/US2007/071935, European Patent Office.

International Search Report, Jan. 8, 2008, pp. 1-7, PCT/US2007/071935, European Patent Office.

Written Opinion of the International Searching Authority, Jan. 8, 2008, pp. 1-9, PCT/US2007/071935, European Patent Office.

* cited by examiner

DOWNHOLE ABRADING TOOLS HAVING FUSIBLE MATERIAL AND METHODS OF DETECTING TOOL WEAR

BACKGROUND

1. Field of Invention

The invention is directed to downhole abrading tools utilized in oil and gas wells to abrade objects within the well and, in particular, to downhole mills that are used to abrade, among other objects, stuck tools, bridge plugs, well tubing, and well casing disposed within the well.

2. Description of Art

In the drilling, completion, and workover of oil and gas wells, it is common to perform work downhole in the well bore with a tool which has some sort of wearable working profile interfacing with a downhole structure. Examples would be milling a downhole metal object with a milling tool, performing a washover operation with a rotary shoe, cutting through a tubular with a cutting or milling tool, or drilling through formation with a drill bit. During the performance of these operations, it is common for the working profile of the tool, such as the cutting elements mounted on its lower or outer face, to wear away. As this wear progresses, the effectiveness of the tool decreases.

It is desirable to pull the tool from the well and replace it, when the working profile has experienced a given amount of wear. The degree of wear at which it is desirable to replace the tool depends upon the type of tool and the operation being performed. Unfortunately, it is difficult or even impossible for the well operator at the surface of the well to know accurately when this given amount of wear has occurred. Often, the decision as to when to pull the tool depends substantially upon the experience of the operator. That is, the operator must estimate the amount of tool wear based on whatever is known about the time the operation has been underway, the weight on the tool, the type of downhole structure being worked, the cuttings found in the drilling fluid, or a gradual change in work string torque. None of these parameters provides a definitive indication that the wear in the working profile has progressed to a specific degree at which the operator desires to pull the tool from the well. Pulling a tool prematurely adds unnecessary trips out of the well, adding to rig time and increased costs. Pulling the tool too late gradually decreases the effectiveness of the downhole operation, also adding to rig time and increasing the cost of the operation.

Accordingly, downhole abrading tools and methods of indicating to an operator of a downhole abrading tool of excessive wear on a cutting end of the downhole abrading tool have been desired in the art. As discussed herein, the present downhole abrading tools and methods of indicating to an operator of a downhole abrading tool of excessive wear on the cutting end of a downhole abrading tool effectively and efficiently identify excessive wear on the downhole abrading tool. Therefore, the operator of the downhole abrading tool is informed of when the downhole abrading tool should be removed from the well and replaced.

SUMMARY OF INVENTION

Broadly, the invention is directed to downhole abrading tools utilized in cutting or abrading objects disposed within the well. The term "object" encompasses any physical structure that may be disposed within a well, for example, another tool that is stuck within the well, a bridge plug, the well tubing, or the well casing.

The downhole abrading tool comprises a body having a first end for connection to a drill string, a cutting end, and a drilling fluid passageway. The downhole abrading tools of the invention include a fusible material disposed within the cutting end, e.g., the matrix disposed at the cutting end of the tool. When exposed to the well environment due to excessive wear on the cutting end of the tool, the temperature of the fusible material increases due to friction. At a certain temperature, the fusible material ignites and combusts. As a result, a temperature change may be measured as an indication that the tool has experienced excessive wear. Additionally, the combustion of the fusible material may create a flow path through which the drilling fluid is permitted to pass. As a result, the pressure of the drilling fluid, being monitored by the operator at the surface, will noticeably drop to indicate that the tool has experienced excessive wear.

A further feature of the downhole abrading tool is that the indication to the operator of the downhole abrading tool may be a temperature change. Another feature of the downhole abrading tool is that the indication to the operator of the downhole abrading tool may be a pressure change in a drilling fluid flowing through the drilling fluid passageway. An additional feature of the downhole abrading tool is that a fluid flow path from the drilling fluid passageway to a well environment may be formed by the combustion of the fusible material to permit drilling fluid to flow from the drilling fluid passageway into the well environment. Still another feature of the downhole abrading tool is that the downhole abrading tool may further comprise a combustible plug in contact with the fusible material, wherein the combustible plug is in fluid communication with the drilling fluid passageway and an exterior surface of the downhole abrading tool, such that, when the combustible plug is combusted by the combustion of the fusible material, a fluid flow path from the drilling fluid passageway and to the exterior surface of the downhole abrading tool is created.

A further feature of the downhole abrading tool is that the downhole abrading tool may further comprise a piston in fluid communication with the drilling fluid passageway for causing the pressure change in the drilling fluid, wherein the piston is moved from an initial position to a second position, and a trigger device causes the piston to move to the second position in response to the combustion of the fusible material. Another feature of the downhole abrading tool is that the downhole abrading tool may further comprise a port in fluid communication with the drilling fluid passageway and an exterior surface of the downhole abrading tool; and a sleeve disposed along the exterior surface of the downhole abrading tool and over the port and in contact with the fusible material to prevent a drilling fluid from flowing from the drilling fluid passageway through the port into a well environment, wherein a fluid flow path from the drilling fluid passageway to a well environment is formed by the combustion of the fusible material, which moves the sleeve to permit a drilling fluid to flow from the drilling fluid passageway, through the port, into the well environment. An additional feature of the downhole abrading tool is that the downhole abrading tool may further comprise a combustible plug in contact with the fusible material, wherein the combustible plug is in fluid communication with the sleeve, such that, when the combustible plug is combusted by the combustion of the fusible material, a fluid flow path from the drilling fluid passageway, through the port, and to the exterior surface of the downhole abrading tool is created. Still another feature of the downhole abrading tool is that the downhole abrading tool may further comprise a port in fluid communication with the drilling fluid passageway and an exterior surface; a cavity in fluid communication with the port, the cavity having an upper cavity portion and a lower cavity portion; and a sleeve slidably disposed within the upper cavity portion and the lower cavity portion and over the port and in contact with the fusible material to prevent a drilling fluid from flowing from the drilling fluid passageway and through the port to a well environment, wherein a fluid flow path from the drilling fluid passageway to a well environment is formed by the combustion of the fusible material to permit a drilling fluid to flow from the drilling fluid passageway, through the port, into the well environment.

A further feature of the downhole abrading tool is that the downhole abrading tool may further comprise a first taggant chamber in fluid communication with the fusible material, the first taggant chamber having at least one taggant and the fusible material being in fluid communication with an exterior surface; wherein the indication to the operator is at least one taggant flowing from the first taggant chamber into a well environment when the fusible material is combusted. Another feature of the downhole abrading tool is that the downhole abrading tool may further comprise a sleeve disposed along the exterior surface and over the taggant chamber to prevent each of the at least one taggants from flowing from the first taggant chamber into a well environment, and wherein a taggant flow path from the taggant chamber to the well environment is formed by the combustion of the fusible material, which moves the sleeve to permit the at least one taggant to flow from the first taggant chamber into the well environment.

An additional feature of the downhole abrading tool is that at least one of the at least one taggants may be selected from the group consisting of a radio-frequency tag, a colored dye, a radioactive material, and a florescent material. Still another feature of the downhole abrading tool is that at least one of the at least one taggants may include a pellet, wherein each of the at least one pellets includes an outer shell encasing a core, the outer shell being dissolvable in a milling fluid and the core being an expandable material. A further feature of the downhole abrading tool is that the expandable material may be styrofoam.

In accordance with the invention, the foregoing advantages also have been achieved through a downhole abrading tool having a body with a first end for connection to a drill string, a cutting end, and a drilling fluid passageway. The downhole abrading tool also has a fusible material in the body that ignites and combusts in response to a selected temperature increase due to excessive wear of the cutting end. The combustion of the fusible material provides an increase in temperature of the cutting end and a fluid flow path from the drilling fluid passageway to a well environment to permit a drilling fluid to flow from the drilling fluid passageway into the well environment and, thus, provide a pressure change in the drilling fluid flowing through the drilling fluid passageway, and wherein the increase in temperature and the pressure change are detectable by an operator of the downhole abrading tool.

A further feature of the downhole abrading tool is that the downhole abrading tool may further comprise a combustible plug in contact with the fusible material, wherein the combustible plug is in fluid communication with the drilling fluid passageway and an exterior surface of the downhole abrading tool, such that, when the combustible plug is combusted by the combustion of the fusible material, a fluid flow path from the drilling fluid passageway and to the exterior surface of the downhole abrading tool is created. Another feature of the downhole abrading tool is that the downhole abrading tool may further comprise a first taggant chamber having at least one taggant, and the first taggant being in fluid communication with an exterior surface; wherein at least one of the at least one taggants is permitted to flow from the first taggant chamber into a well environment when the fusible material is combusted, and wherein at least one of the at least one taggants is detectable by the operator of the downhole abrading tool.

In accordance with the invention, the foregoing advantages have been achieved through the present method of indicating to an operator of a downhole abrading tool of excessive wear on a cutting end of the downhole abrading tool. The method comprises the steps of: providing a downhole abrading tool having a body having a first end for connection to a drill string, a cutting end, a drilling fluid passageway, and a fusible material in the body; disposing the downhole abrading tool within a well; contacting the cutting end with an object disposed within the well; rotating the downhole abrading tool in contact with the object to abrade the object; flowing a drilling fluid through the drill fluid passageway to facilitate the abrading of the object; abrading the object for a sufficient amount of time for the fusible material to heat to the selected temperature to cause the fusible material to combust; creating by the combustion of the fusible material an indication to the operator of the downhole abrading tool of excessive wear on the cutting end.

Further features of the method of indicating to an operator of a downhole abrading tool of excessive wear on a cutting end of the downhole abrading tool is that the indication to the operator of the downhole abrading tool may be a temperature change or a pressure change in a drilling fluid flowing through the drilling fluid passageway, the pressure change being formed by creating a flow path from a well environment to the drilling fluid passageway by the combusted fusible material to permit drilling fluid to flow from the drilling fluid passageway through the flow path to create a pressure change in the drilling fluid flowing through the downhole abrading tool.

The downhole abrading tools and methods of indicating to an operator of a downhole abrading tool of excessive wear on a cutting end of the downhole abrading tool have the advantages of providing effective and efficient identification of excessive wear on the downhole abrading tool.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
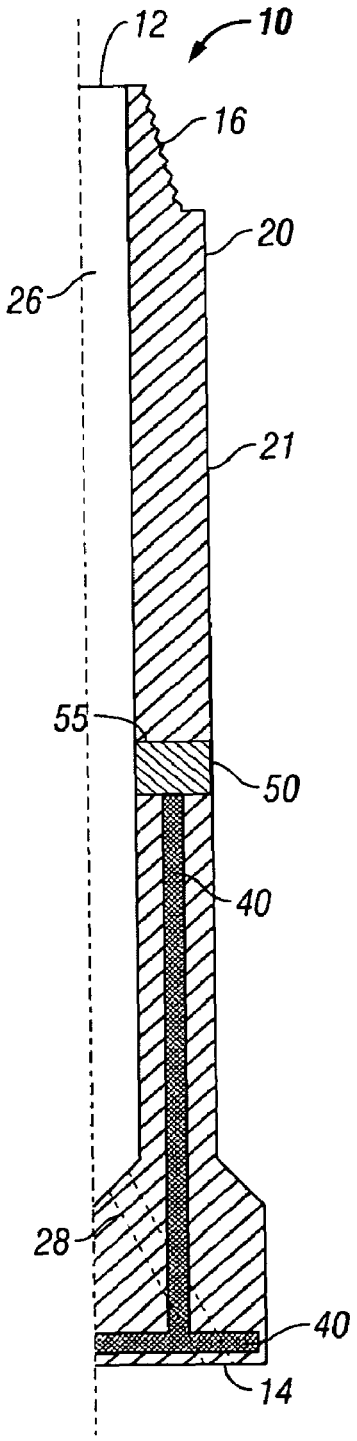
FIG. 1 is partial cross-sectional view of a specific embodiment of a downhole abrading tool of the present invention.

Referring to FIG. 1, downhole abrading tool, or mill, 10 has first end 12 and cutting end 14. First end 12 is adapted to be connected to a string (not shown) to facilitate rotation of downhole abrading tool 10. As shown in FIGS. 1-3 and 8-9, first end 12 includes threads 16 to facilitate attachment to the string.

Downhole abrading tool 10 includes body 20 having exterior surface 21. Body includes drilling fluid passageway 26 disposed longitudinally within body 20. Drilling fluid 22 flows from the surface, through drilling fluid passageway 26, and through drilling fluid nozzles 28 (shown in dashed lines) into the well environment and back to the surface of the well. The drilling fluid facilitates cutting by downhole abrading tool 10.

Cutting end 14 includes matrix 18, such as hardfacing or other cutting material known in the art, having fusible material 40 disposed therein. When exposed to the well environment due to excessive wear on cutting end 14 of downhole abrading tool 10, the temperature of fusible material 40 increases due to friction. At a certain temperature, fusible material 40 ignites and combusts. As a result, a temperature change may be measured as an indication that downhole abrading tool 10 has experienced excessive wear. The temperature may be sensed by any method or device known in the art. For example, downhole abrading tool 10 may include a sensor that is activated by an increase in temperature and causes downhole abrading tool 10, or another tool disposed in close proximity to downhole abrading tool, to pulse the drilling fluid flowing up around the string. The pulse is then identified by the operator as an indication that downhole abrading tool 10 has experienced excessive wear.

Additionally, as discussed below in greater detail with respect to each of the embodiments illustrated in FIGS. 1-9, the combustion of fusible material 40 may create a flow path through which the drilling fluid is permitted to pass. As a result, the pressure of the drilling fluid, being monitored by the operator at the surface, will noticeably drop to indicate that the tool has experienced excessive wear.

Fusible material 40 is preferably a material that does not require oxygen to combust and, once ignited, continues to burn until the all combustible material in contact with fusible material 40 also combusts. A preferred fusible material 40 is PYROFUZE® available from Sigmund Cohn Corp. of Mount Vernon, New. York. The PYROFUZE® fusible material consists of two metallic elements in intimate contact with each other. When the two elements are brought to the initiating temperature, or selected temperature increase, they alloy rapidly resulting in instant deflagration without support of oxygen. The reaction end products consist normally of tiny discreet particles of the alloy of the two metallic elements. Therefore, after the fusible material 40 combusts, the area and volume in which fusible material 40 was previous disposed becomes mostly void, or forms a cavity, and fluid is permitted to pass through that void or cavity.

Referring now to FIG. 1, in one specific embodiment, downhole abrading tool 10 includes combustible plug 50 in fluid communication with fusible material 40, drilling fluid passageway 26, and exterior surface 21. Upon cutting end 14 undergoing excessive wear such that fusible material 40 is exposed to the well environment and, thus, rotated against the object being abraded. The rotation of fusible material 40 against the object creates friction which, in turn, generates heat and increases the temperature of fusible material 40. At a selected temperature increase, fusible material 40 ignites and combusts. The combustion of the fusible material 40 ignites and combusts combustible plug 50. As a result, flow path 55 is formed by the void or cavity left by the combustion of combustible plug 50. Accordingly, drilling fluid (not shown) is permitted to flow from drilling fluid passageway 26 into the well environment causing a pressure change in the drilling fluid that is observed by the operator as an indication that downhole abrading tool 10 should be replaced.

Figure 2:
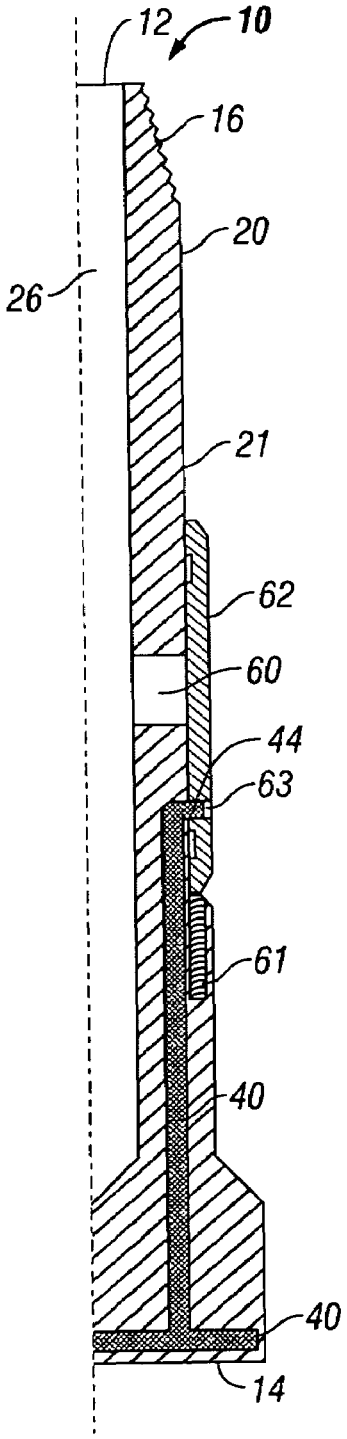
FIG. 2 is partial cross-sectional view of another specific embodiment of a downhole abrading tool of the present invention.

Referring now to FIG. 2, body 20 includes port 60 in fluid communication with drilling fluid passageway 26. Sleeve 62 is disposed along exterior surface 21 and over port 60 to prevent drilling fluid from flowing from drilling fluid passageway 26, through port 60, and into the well environment. Sleeve 62 is in communication with fusible material 40 so that, when fusible material 40 is combusted due to excessive wear as discussed above, sleeve 62 is released from exterior surface 21. As shown in FIG. 2, sleeve 62 includes shear pin 63 in fluid communication with fusible material 40. As shown combustible plug 44 is disposed next to shear pin 44. Disposed below sleeve 62 and within body 20 is spring 61. Initially, spring 61 is under compression. When excessive wear of cutting end 14 occurs, fusible material 40 and, thus, combustible plug 44, combust leaving only shear pin 63 maintaining sleeve 62 in place. Due to the force of spring 61, shear pin 63 breaks. Combustible plug 44 may be formed at the same material as fusible material 40 or any other material known to persons of ordinary skill in the art that is capable of combusting due to the combustion of fusible material 40. Accordingly, sleeve 62 no longer is capable of maintaining spring 61 in a compressed state. Spring 61, therefore, decompresses and pushes sleeve 62 in an upward direction along exterior surface 21 until sleeve 62 is no longer blocking port 60. As a result, sleeve 62 no longer prevents drilling fluid from flowing from drilling fluid passageway 26, through port 60, and into the well environment. Accordingly, a pressure change in the drilling fluid is observed by the operator as an indication that downhole abrading tool 10 should be replaced. While the embodiment of FIG. 2 shows the inclusion of shear pin 63, it is to be understood that shear pin 63 is not required. Instead, shear pin 63 may be replaced with a larger combustible plug 44 or, additional fusible material 40.

Figure 3:
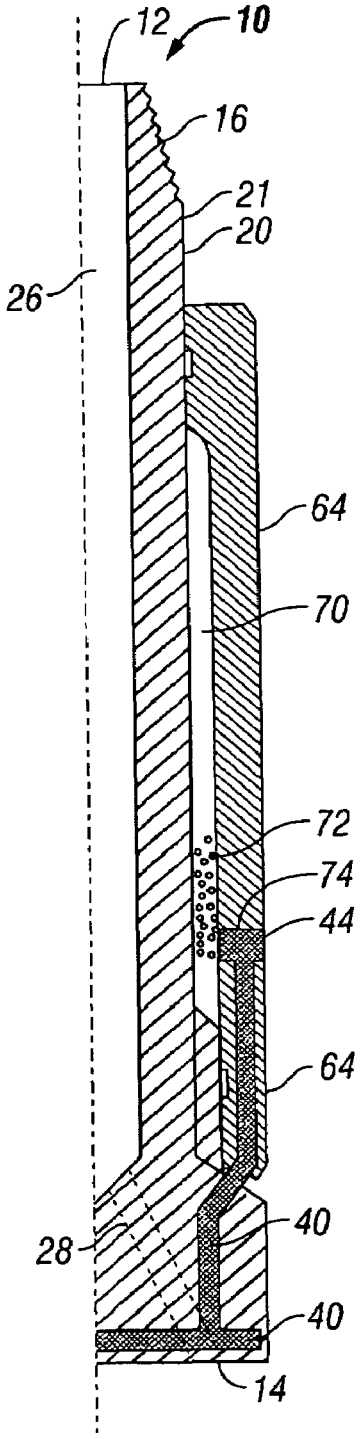
FIG. 3 is partial cross-sectional view of still another specific embodiment of a downhole abrading tool of the present invention.

Referring now to FIG. 3, body 20 includes taggant chamber 70 along exterior surface 21 formed by exterior surface 21 and sleeve 64. Disposed with taggant chamber are individual taggants 72. Each taggant 72 may be, for example, a colored dye, a radiofrequency tag, a radioactive material, a florescent material, or a pellet having an outer shell that is dissolvable in the drilling fluid encasing a core formed of an expandable material such as styrofoam. Sleeve includes combustible plug 44. Prior to combustion, combustible plug 44 and sleeve 64 prevent taggants 72 from flowing from taggant chamber 70 into the well environment.

Combustible plug 44 is in communication with fusible material 40 so that, when fusible material 40 is combusted due to excessive wear as discussed above, combustible plug 44 also combusts. As a result, taggant flow path 74 is formed and taggants 72 are permitted to flow from taggant chamber 70, through taggant flow path 74, and into the well environment. Taggants 72 are carried to the surface of the well by the drilling fluid where they are observed by the operator as an indication that downhole abrading tool 10 should be replaced.

Figure 4:
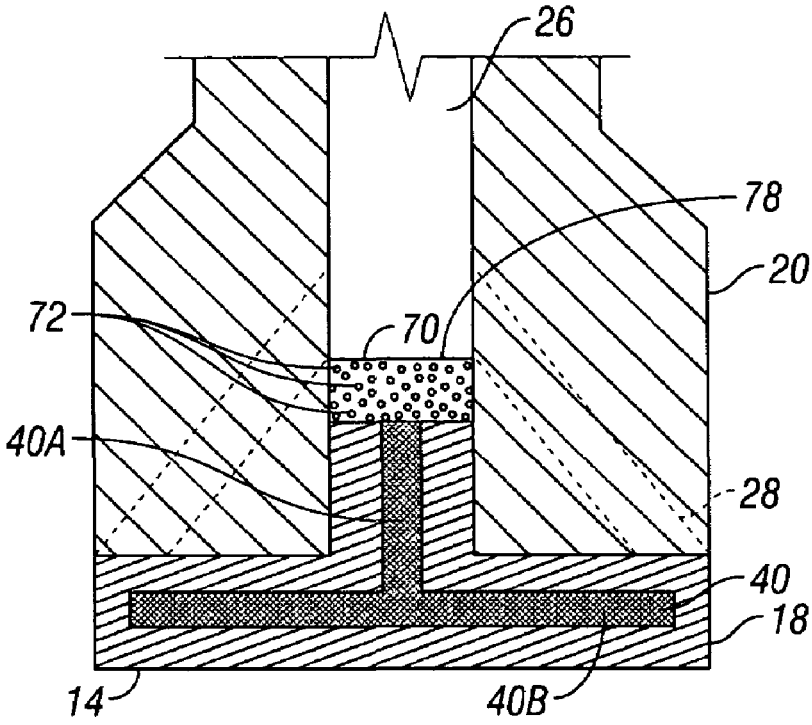
FIG. 4 is partial cross-sectional view of yet another specific embodiment of a downhole abrading tool of the present invention.

In the embodiment illustrated in FIG. 4, taggant chamber 78 is disposed in fluid communication with fusible material 40 in close proximity to cutting end 13. Fusible material 40 is disposed within matrix 18. Matrix 18 may be hardfacing, or any other material known in the art used to facilitate cutting or abrading. In this embodiment, fusible material 40 has vertical component 40*a* and horizontal component 40*b*. Horizontal component 40*b* is exposed to the well environment when matrix 18 wears away. Vertical component 40*b* extends up to taggant chamber 78. When fusible material 40 combusts, a flow path from taggant chamber 78 through exterior surface 21 to the well environment is formed. Thus, when fusible material 40 is combusted due to excessive wear on cutting end 14, taggants 72 are permitted to flow from taggant chamber 78 through the void or cavity created by the combustion of fusible material 40, and into the well environment.

Figure 5:
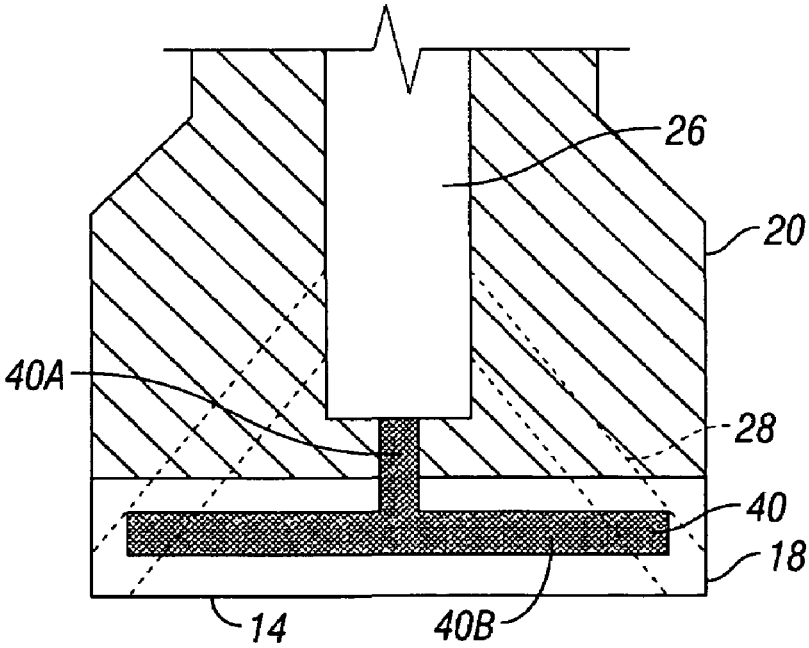
FIG. 5 is partial cross-sectional view of an additional specific embodiment of a downhole abrading tool of the present invention.
Figure 6:
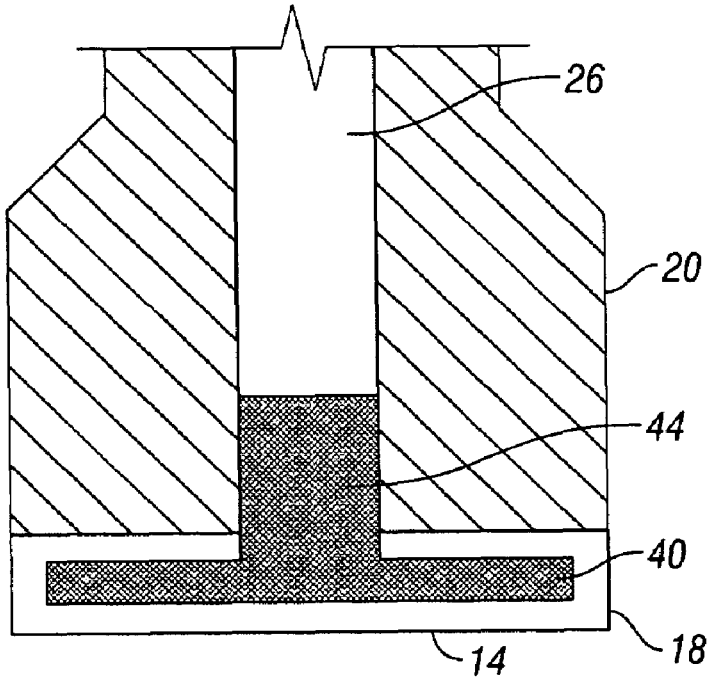
FIG. 6 is partial cross-sectional view of a further specific embodiment of a downhole abrading tool of the present invention.
Figure 7:
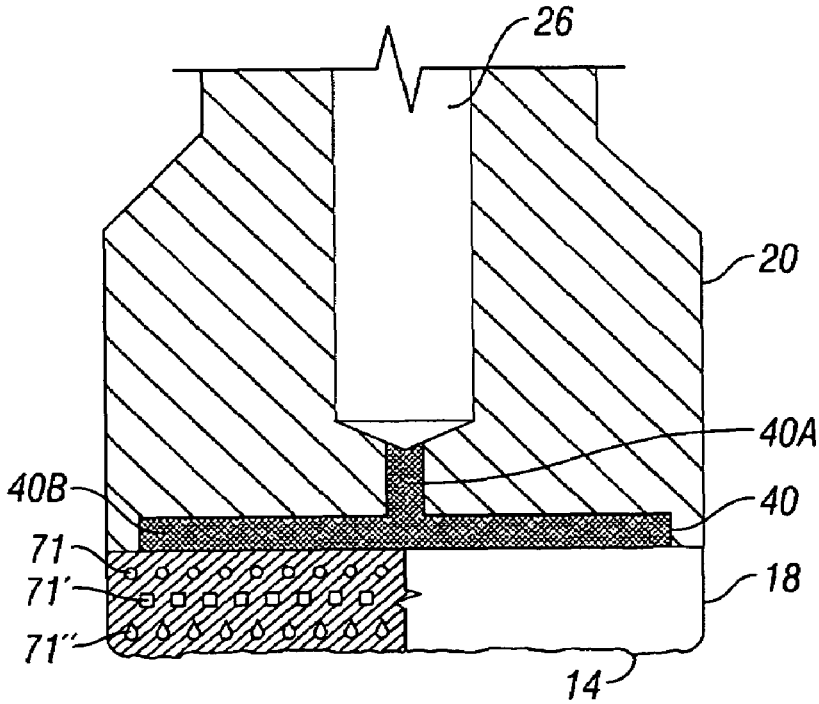
FIG. 7 is partial cross-sectional view of yet a further specific embodiment of a downhole abrading tool of the present invention.

Referring to FIGS. 5-7, fusible material 40 is disposed within matrix 18 and is in fluid communication with drilling fluid passageway 26 (FIGS. 5 and 7) or combustible plug 44 (FIG. 6). In FIGS. 5 and 7, fusible material 40 has vertical component 40*a* and horizontal component 40*b*. When cutting end 14 experiences excessive wear, fusible material 40 is exposed and combusts, resulting in a drilling fluid flow path being formed from drilling fluid passageway 26 into the well environment. Accordingly, a pressure change in the drilling fluid is observed by the operator as an indication that downhole abrading tool 10 should be replaced.

With respect to FIG. 7, in another specific embodiment, taggants 72, 72', and 72" are disposed within matrix 18. Preferably, different taggants 72 are disposed at different locations within matrix 18, thereby providing different indications as to the extent of wear on cutting end 14. For example, taggants 72" are released prior to taggants 72' and taggants 72' are released prior to taggants 72. Accordingly, an operator is provided with incremental indication as to the wear on cutting end 14. Alternatively, taggants 72, 72', and 72" can be disposed in specific areas of matrix 18, e.g., taggants 72 on the sides, taggants 72' on the bottom and taggants 72" in the middle so that an indication can be made as to the specific area or region of cutting end 14 undergoing wear.

As further shown in FIG. 7, fusible material 40 is disposed above taggants 72, 72', and 72". Therefore, taggants 72, 72', and 72" provide incremental warnings to the operator that wear on cutting end 14 is increasing and fusible material 40 is closer to being exposed and combusted such that a drilling fluid flow path is formed from drilling fluid passageway 26 into the well environment as discussed in greater detail above.

Figure 8:
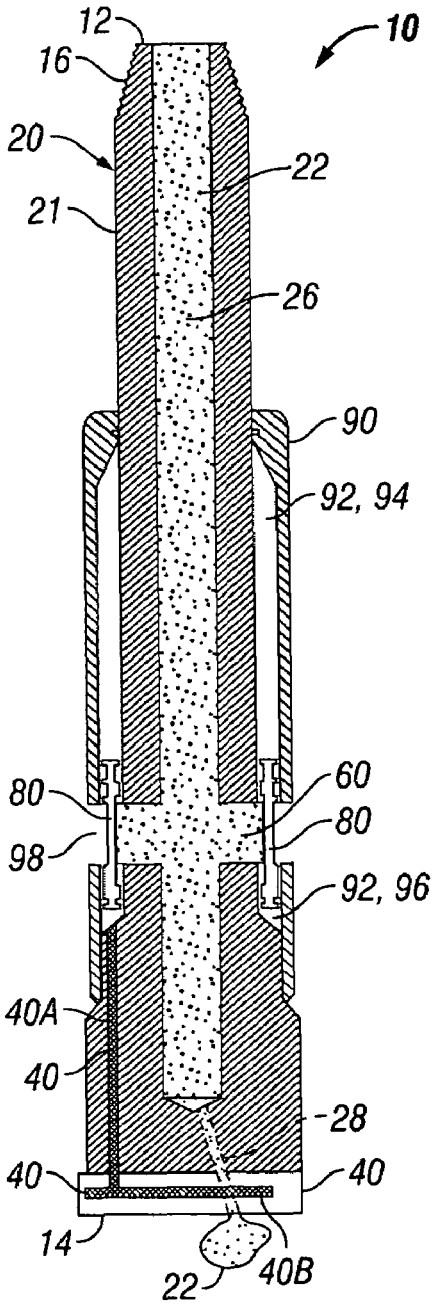
FIG. 8 is cross-sectional view of one more specific embodiment of a downhole abrading tool of the present invention.
Figure 9:
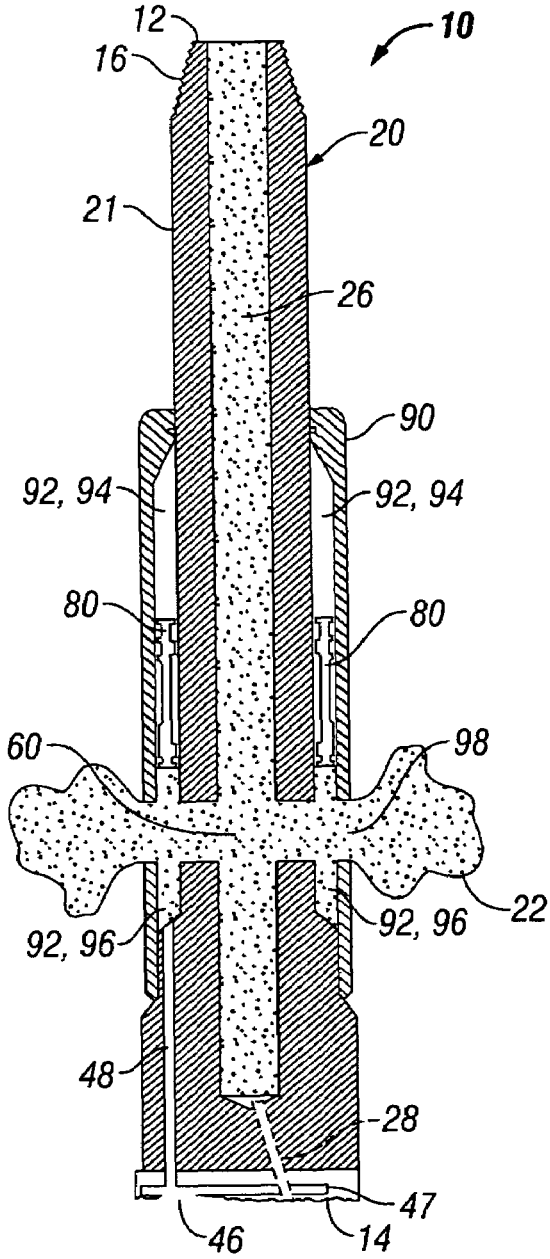
FIG. 9 is cross-sectional view of the specific embodiment shown in FIG. 8 to which the downhole abrading tool has experience excessive wear.

Referring now to FIGS. 8 and 9, downhole abrading tool 10 includes chamber 90 disposed along exterior surface 21 of downhole abrading tool 10. Chamber 90 includes cavity 92 having upper cavity portion 94 and lower cavity portion 96 and window 98. Window 98 is in fluid communication with cavity 92. Cavity 92 and, thus, upper cavity portion 94 and lower cavity portion 96, are initially at atmospheric pressure. Port 60 is in fluid communication with drilling fluid passageway 26 and cavity 92. Disposed within cavity 92 is piston 80 which is capable of sliding along exterior surface 21 within cavity 92. Preferably, piston 80 is an annular piston.

As shown in FIG. 8, fusible material 40 is disposed within matrix 18 near cutting end 14. Fusible material 40 is also disposed within body 20 and in fluid communication with fusible material 40 disposed within matrix 18 and in fluid communication with cavity 92. In the embodiment illustrated in FIG. 8, fusible material 40, therefore, includes vertical component 40*a* and horizontal component 40*b* as discussed in greater detail above.

When cutting end 14 experiences excessive wear 46, fusible material 40 is exposed and combusts as discussed in greater detail above. After combustion (FIG. 9), fusible material cavity 47 and flow path 48 are formed. As a result, the atmospheric pressure in lower cavity portion 96 increases to the drilling fluid pressure on exterior surface 21 of downhole abrading tool 10. Accordingly, a pressure difference between the pressure in upper cavity portion 94 and lower cavity portion 96 and the well environment causes piston 80 to move into upper cavity portion 94, creating a drilling fluid flow path from drilling fluid passageway 26, through port 60, through cavity 92, through window 98, and into the well environment. Accordingly, a pressure change in the drilling fluid is observed by the operator as an indication that downhole abrading tool 10 should be replaced.

It is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims.

What is claimed is:

1. A downhole abrading tool comprising:

a body having a first end for connection to a drill string, a cutting end, and a drilling fluid passageway; and a fusible material in the body that, when exposed to a wellbore environment, ignites and combusts in response to a selected temperature increase due to excessive wear on the cutting end, wherein the combustion of the fusible material provides an indication to an operator of the downhole abrading tool of the excessive wear on the cutting end of the downhole abrading tool.

2. The downhole abrading tool of claim 1, wherein the indication to the operator of the downhole abrading tool is a temperature change.

3. The downhole abrading tool of claim 1, wherein the indication to the operator of the downhole abrading tool is a pressure change in a drilling fluid flowing through the drilling fluid passageway.

4. The downhole abrading tool of claim 3, wherein a fluid flow path from the drilling fluid passageway to a well environment is formed by the combustion of the fusible material to permit a drilling fluid to flow from the drilling fluid passageway into the well environment.

5. The downhole abrading tool of claim 1, wherein the downhole abrading tool further comprises a combustible plug in contact with the fusible material, wherein the combustible plug is in fluid communication with the drilling fluid passageway and an exterior surface of the downhole abrading tool, such that, when the combustible plug is combusted by the combustion of the fusible material, a fluid flow path from the drilling fluid passageway and to the exterior surface of the downhole abrading tool is created.

6. The downhole abrading tool of claim 3, wherein the downhole abrading tool further comprises a piston in fluid communication with the drilling fluid passageway for causing the pressure change in the drilling fluid, wherein the piston is moved from an initial position to a second position, and a trigger device causes the piston to move to the second position in response to the combustion of the fusible material.

7. The downhole abrading tool of claim 3, wherein the downhole abrading tool further comprises:

a port in fluid communication with the drilling fluid passageway and an exterior surface of the downhole abrading tool; and a sleeve disposed along the exterior surface of the downhole abrading tool and over the port and in contact with the fusible material to prevent a drilling fluid from flowing from the drilling fluid passageway through the port into a well environment, wherein a fluid flow path from the drilling fluid passageway to a well environment is formed by the combustion of the fusible material, which moves the sleeve to permit a drilling fluid to flow from the drilling fluid passageway, through the port, into the well environment.

8. The downhole abrading tool of claim 7, wherein the downhole abrading tool further comprises a combustible plug in contact with the fusible material, wherein the combustible plug is in fluid communication with the sleeve, such that, when the combustible plug is combusted by the combustion of the fusible material, a fluid flow path from the drilling fluid passageway, through the port, and to the exterior surface of the downhole abrading tool is created.

9. The downhole abrading tool of claim 3, wherein the downhole abrading tool further comprises:

a port in fluid communication with the drilling fluid passageway and an exterior surface;

a cavity in fluid communication with the port, the cavity having an upper cavity portion and a lower cavity portion; and a sleeve slidably disposed within the upper cavity portion and the lower cavity portion and over the port and in contact with the fusible material to prevent a drilling fluid from flowing from the drilling fluid passageway and through the port to a well environment, wherein a fluid flow path from the drilling fluid passageway to a well environment is formed by the combustion of the fusible material to permit a drilling fluid to flow from the drilling fluid passageway, through the port, into the well environment.

10. The downhole abrading tool of claim 1, wherein the downhole abrading tool further comprises:

a first taggant chamber in fluid communication with the fusible material, the first taggant chamber having at least one taggant, the fusible material being in fluid communication with an exterior surface;

wherein the indication to the operator is at least one taggant flowing from the first taggant chamber into a well environment when the fusible material is combusted.

11. The downhole abrading tool of claim 10, wherein the downhole abrading tool further comprises a sleeve disposed along the exterior surface and over the taggant chamber to prevent each of the at least one taggants from flowing from the first taggant chamber into a well environment, and wherein a taggant flow path from the taggant chamber to the well environment is formed by the combustion of the fusible material, which moves the sleeve to permit the at least one taggant to flow from the first taggant chamber into the well environment.

12. The downhole abrading tool of claim 10, wherein at least one of the at least one taggants is selected from the group consisting of a radio-frequency tag, a colored dye, a radioactive material, a florescent material, and mixtures thereof.

13. The downhole abrading tool of claim 10, wherein at least one of the at least one taggants includes a pellet, wherein each of the at least one pellets includes an outer shell encasing a core, the outer shell being dissolvable in a milling fluid and the core being an expandable material.

14. The downhole abrading tool of claim 13, wherein the expandable material is styrofoam.

15. A downhole abrading tool comprising:

a body having a first end for connection to a drill string, a cutting end, and a drilling fluid passageway; and a fusible material in the body that ignites and combusts in response to a selected temperature increase due to excessive wear of the cutting end, wherein the combustion of the fusible material provides an increase in temperature of the cutting end and a fluid flow path from the drilling fluid passageway to a well environment to permit a drilling fluid to flow from the drilling fluid passageway into the well environment and, thus, provide a pressure change in the drilling fluid flowing through the drilling fluid passageway, and wherein the increase in temperature and the pressure change are detectable by an operator of the downhole abrading tool.

16. The downhole abrading tool of claim 15, wherein the downhole abrading tool further comprises a combustible plug in contact with the fusible material, wherein the combustible plug is in fluid communication with the drilling fluid passageway and an exterior surface of the downhole abrading tool, such that, when the combustible plug is combusted by the combustion of the fusible material, a fluid flow path from the drilling fluid passageway and to the exterior surface of the downhole abrading tool is created.

17. The downhole abrading tool of claim 15, wherein the downhole abrading tool further comprises:

a first taggant chamber having at least one taggant, the first taggant chamber being in fluid communication with an exterior surface;

wherein at least one of the at least one taggants is permitted to flow from the first taggant chamber into a well environment when the fusible material is combusted, and wherein at least one of the at least one taggants is detectable by the operator of the downhole abrading tool.

18. A method of indicating to an operator of a downhole abrading tool of excessive wear on a cutting end of the downhole abrading tool, the method comprising the steps of:

providing a downhole abrading tool having a body having a first end for connection to a drill string, a cutting end, a drilling fluid passageway, and a fusible material in the body;

disposing the downhole abrading tool within a well;

contacting the cutting end with an object disposed within the well;

rotating the downhole abrading tool in contact with the object to abrade the object;

flowing a drilling fluid through the drill fluid passageway to facilitate the abrading of the object;

abrading the object for a sufficient amount of time for the fusible material to heat to the selected temperature to cause the fusible material to combust; and, creating by the combustion of the fusible material, an indication to the operator of the downhole abrading tool of excessive wear on the cutting end.

19. The method of claim 18, wherein the indication to the operator of the downhole abrading tool is a temperature change.

20. The method of claim 18, wherein the indication to the operator of the downhole abrading tool is a pressure change in the drilling fluid flowing through the drilling fluid passageway, the pressure change being formed by creating a flow path from a well environment to the drilling fluid passageway by the combusted fusible material to permit drilling fluid to flow from the drilling fluid passageway through the flow path to create a pressure change in the drilling fluid flowing through the downhole abrading tool.

* * * * *